US007766000B2

(12) United States Patent
Maeda

(10) Patent No.: US 7,766,000 B2
(45) Date of Patent: Aug. 3, 2010

(54) AIR GUN WITH A BLOWBACK MECHANISM

(75) Inventor: Tetsuo Maeda, Tokyo (JP)

(73) Assignee: Maruzen Company Limited, Tokyo (JP)

( * ) Notice: Subject to any disclaimer, the term of this patent is extended or adjusted under 35 U.S.C. 154(b) by 24 days.

(21) Appl. No.: 12/222,186

(22) Filed: Aug. 5, 2008

(65) Prior Publication Data

US 2010/0031944 A1 Feb. 11, 2010

(51) Int. Cl.
*F41B 11/06* (2006.01)

(52) U.S. Cl. ..... 124/74

(58) Field of Classification Search ..... 124/74
See application file for complete search history.

(56) References Cited

U.S. PATENT DOCUMENTS

| | | | | |
|---|---|---|---|---|
| 2,554,116 | A * | 5/1951 | Monner | 124/74 |
| 2,881,752 | A * | 4/1959 | Blahnik | 124/75 |
| 5,476,087 | A * | 12/1995 | Kunimoto | 124/73 |
| 5,884,615 | A * | 3/1999 | Casas | 124/71 |
| 6,026,797 | A * | 2/2000 | Maeda et al. | 124/74 |
| 6,314,954 | B1 * | 11/2001 | Wang | 124/74 |
| 6,494,194 | B2 * | 12/2002 | Shipachev et al. | 124/73 |
| 6,497,229 | B1 * | 12/2002 | Maeda | 124/76 |
| RE39,805 | E * | 9/2007 | Maeda et al. | 124/74 |
| 7,267,119 | B2 * | 9/2007 | Maeda et al. | 124/73 |
| 7,353,816 | B2 | 4/2008 | Maeda et al. | |
| 2006/0162711 | A1 * | 7/2006 | Maeda et al. | 124/73 |
| 2007/0181116 | A1 | 8/2007 | Wei | |
| 2008/0017180 | A1 * | 1/2008 | Maeda et al. | 124/74 |

FOREIGN PATENT DOCUMENTS

| | | | |
|---|---|---|---|
| DE | 198 47 638 | A1 | 4/2000 |
| EP | 1 939 576 | A1 | 7/2008 |

OTHER PUBLICATIONS

Extended European Search Report, App. No. 08014231.8-1260, Feb. 6, 2009 (9 pages).

* cited by examiner

*Primary Examiner*—Troy Chambers
*Assistant Examiner*—Reginald Tillman, Jr.
(74) *Attorney, Agent, or Firm*—Rader, Fishman & Grauer PLLC

(57) ABSTRACT

The structure of air guns with a conventional blowback mechanism was complicated because they had a hammer, sear, trigger bar, bullet supply nozzle, bullet supply nozzle link, etc. These members operated every time when a bullet was shot resulting in the members being readily worn, with failure often occurring as well as problems with durability. In order to solve these problems, the valve body has a valve body air chamber sealed to contain the compressed gas supplied from the compressed gas source, and has a discharge valve which can move in a longitudinal direction. The discharge valve has a valve through hole that passes completely from the muzzle to the gun rear end direction, and a gas supply port that can open and close the valve body air chamber and valve through hole by the movement of the discharge valve in the longitudinal direction. Retreat of the inner barrel opens the gas supply port of the discharge valve to shoot a bullet and perform blowback.

2 Claims, 20 Drawing Sheets

AIR GUN WITH A BLOWBACK MECHANISM

BACKGROUND OF THE INVENTION

1. Field Of The Invention

The present invention relates to an air gun, for firing a bullet and performing blowback using compressed gas, and having a mechanism for both firing a bullet and performing blowback with energy supplied from compressed gas. More specifically, the structure of the air gun is more simplified compared to air guns having conventional blowback mechanisms and the air gun has a blowback mechanism that shoots a bullet and performs blows-back more effectively.

2. Description of the Related Art

A mechanism of a conventional air gun that shoots a bullet and performs blowback by compressed gas includes a magazine, a compressed air source, a slide, a cylinder, an inner barrel, a barrel body, and trigger. A valve pin is provided in a valve body air chamber that is a space containing compressed gas in the valve body. A hit pin is provided in a gun rear end side of the valve pin. The hit pin has a hammer that rotates backward by the action of the trigger. The hammer that rotates by the action of the trigger hits the hit pin to move the hit pin and valve pin towards the muzzle side of gun, causing the gas in the valve body air chamber to spout onto the valve pin to shoot a bullet and perform blowback.

An air gun that has a blowback mechanism with this construction is disclosed in U.S. Pat. No. 6,026,797 (Related Art 1) that the applicant of the present invention applied for and owns a patent right. The Related Art discloses a following air gun:

This invention can make a valve compact in function and improve usage efficiency of a compressed gas and make an air gun compact. To achieve this object, an air gun is constructed by a hit pin arranged in a cylinder portion, a valve body arranged within a hollow portion of the cylinder portion and having a bullet supplying nozzle chamber and a valve pin chamber, a gas inlet port opened to a sleeve-shaped circumferential face of the valve pin chamber, a bullet supplying nozzle arranged within the bullet supplying nozzle chamber, and a valve pin arranged within the valve pin chamber. The hit pin is pressed on a muzzle side and the valve pin is slid to the muzzle side so that an airtight state between a valve pin flange portion and a side face of the valve pin chamber on its gun rear end side is released. A compressed gas is supplied to a nozzle chamber side opening and a valve pin chamber side opening from a clearance between the valve pin flange portion and the gun rear end side face of the valve pin chamber.

Additionally, U.S. Pat. No. 7,267,119 (Related Art 2) that the applicant of the present invention applied for and owns a patent discloses as follows:

An air gun including a slide, a barrel, a cylinder portion, a hit pin, a hollow valve pin chamber, a valve body, a gas supply port, a valve pin, a pressing section, a bullet feed nozzle link connected to a trigger; and a bullet feed nozzle. When the hit pin is pressed to the muzzle side and made to slide to the muzzle side, the valve pin slides to the muzzle side against an urging force to release an airtight state between the valve pin flange section and the gun rear end side side surface of the valve pin chamber; compressed gas supplied to the valve pin chamber from the gas supply port is supplied from between the valve pin chamber gun rear end side side surface and the valve pin flange section to the valve pin chamber side opening; and a bullet is fired from the muzzle by passing compressed gas through the bullet feed nozzle insertion section a supplying to the muzzle side of the bullet feed nozzle; and compressed gas is supplied from a clearance between the pressing section and through holes into which the pressing section is inserted to the gun rear end side to cause the cylinder section to move to the gun rear end side.

A U.S. Pat. No. 7,353,816 (Related Art 3) is a divisional application of the Related Art 2 and has become common knowledge. In his technology, a gun has a structure where a cylinder that is provided in a gun rear end side of the slide capable of free movement, has a hammer and no hit pin.

Further, the applicant of the present invention applied for a patent of an air gun having a blowback mechanism with a barrel latch in Taiwan on Dec. 7, 2006 as follows (Taiwan Patent Application Number 95145714=U.S. Pat. No. A11/655,205, EPA 06027082.4) (Related Art 4):

An air gun, for firing a bullet using compressed gas, and having a mechanism for blowing back, wherein the blowback mechanism is provided with a firing chamber and a blowback chamber, being two cavities capable of being supplied with compressed gas from a compressed gas source and being sealed to contain the compressed gas, inside a valve body, a firing valve inside the firing chamber, a blowback valve inside the blowback chamber, and two valves that are capable of actuation independent of each other by operation of a trigger.

However, an air gun with a blowback mechanism disclosed in the Related Art 1 to 4 at least has a hammer at the rear end of the gun. The hammer rotates by a trigger bar or a sear that transmits the movement of the trigger, hits a hit pin from behind and moves the hit pin and valve pin from the muzzle side of the gun to eject the gas in the valve body air chamber to the valve pin for firing a bullet and performing blowback.

Therefore, an air gun with a blowback mechanism has members such as a hammer, a sear, a trigger bar, a bullet supplying nozzle, a bullet supplying nozzle link and their fittings, making the structure complicated. The members move every time a bullet is fired so that members are likely to be worn, and the air gun is easily damaged and likely to have problems with durability.

Additionally, in an air gun with a blowback mechanism disclosed in the Related Art 1, in some cases, at first, compressed gas functions as a force to press the cylinder backward, then compressed gas starts applying power on a bullet on the muzzle side. A bullet is fired while the cylinder is retreating, and shooting a bullet during the retreat of the cylinder decreases the grouping on a target.

SUMMARY OF THE INVENTION

Therefore, in consideration of these problems, an object of this invention is to provide an air gun comprising a magazine, a compressed gas source, a slide, a cylinder, an inner barrel, a valve body, a trigger and a mechanism that shoots a bullet using compressed gas and performs blowback, wherein the valve body is provided with a space that is a valve body air chamber capable of being supplied with compressed gas from a compressed gas source and being sealed to contain the compressed gas and a discharge valve that can move from the muzzle side to the gun rear end side in the valve body air chamber;

the discharge valve is provided with a valve through hole extending from the muzzle side to the gun rear end side and a gas supply port that opens and closes the valve body air chamber and the valve through hole by movement from the muzzle side to the gun rear end side; and a blowback mechanism is provided, which moves the discharge valve towards the gun rear end side by the retreat of the inner barrel so that the gas supply port of the discharge valve opens to eject compressed gas to the valve through hole from the valve body air chamber for shooting a bullet and performing blowback.

Further, it is an object of the present invention to provide an air gun comprising a magazine, a compressed gas source, a slide, a cylinder, an inner barrel, a valve body, a barrel latch, a trigger, and a mechanism that shoots a bullet by compressed gas and performs blowback, wherein the valve body is provided with a space that is a valve body air chamber capable of being supplied with compressed gas from a compressed gas source and being sealed to contain the compressed gas and a discharge valve that can move from the muzzle side to the gun rear end side in the valve body air chamber;

the discharge valve is provided with a valve through hole extending from the muzzle side to the gun rear end side and a gas supply port that opens and closes the valve body air chamber and the valve through hole by the movement from the muzzle side to the gun rear end side;

a pin through hole positioned on the muzzle side of the discharge valve that extends from the muzzle side to the gun rear end side is provided, a hit pin that can move from the muzzle side to the gun rear end side and move the discharge valve by retreat of the inner barrel is provided; and a blowback mechanism is provided, in which the inner barrel moves by the movement of the barrel latch moved by the movement of the trigger, the hit pin is moved towards the gun rear end side by the retreat of the inner barrel, the gas supply port of the discharge valve is opened by the movement of the discharge valve towards the gun rear end side, and compressed gas blows out into the valve through hole from the valve body air chamber to shoot a bullet and perform blowback.

The present invention eliminates the need for members such as a hammer, a sear, a trigger bar, a bullet supplying nozzle, a bullet supplying link and fittings that were conventionally used for air guns with a blowback mechanism, and the number of parts is decreased compared to the Related Art, reducing the cost of manufacturing. and problems, and improving durability of an air gun.

Additionally, an air gun with a conventional blowback mechanism becomes ready to shoot a bullet by rotating a hammer through retreat of a slide. According to the present invention, the retreat energy of a slide is smaller than the Related Art because a hammer is not rotated when a slide is retreated so that compressed gas can be used more effectively.

Further, compressed gas according to the present invention can shoot a bullet before retreating a cylinder, different from the Related Art 1. Consequently, an air gun does not move because of retreat of a cylinder, and grouping is rarely affected to improve performance of the air gun.

DESCRIPTION OF THE PREFERRED EMBODIMENTS

Figure 25:
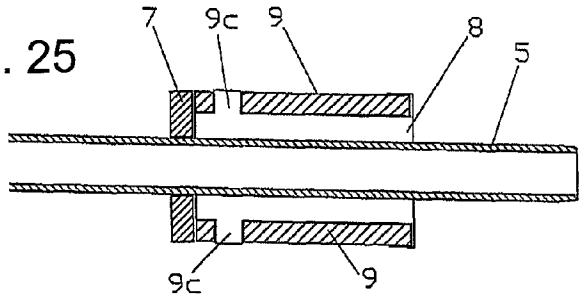
FIG. 25 is an enlarged plane cross-sectional drawing of the essential parts according to an embodiment of the present invention showing the relationship among the barrel housing, the barrel latch and the inner barrel.
Figure 24:
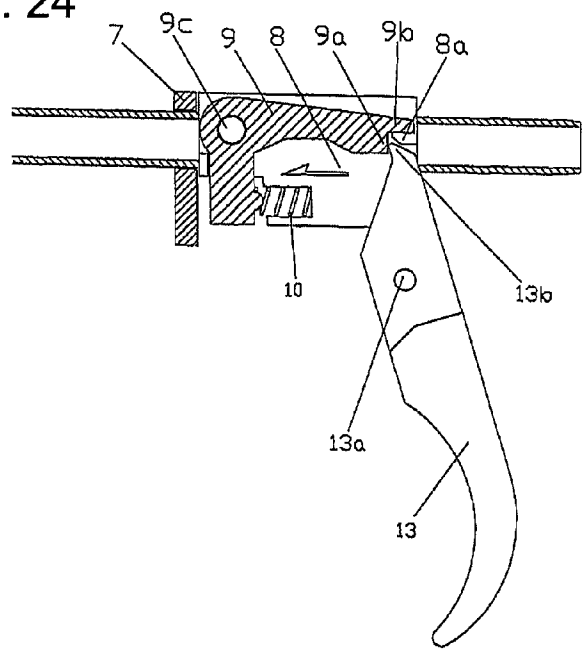
FIG. 24 is an enlarged front cross-sectional drawing of the essential parts according to an embodiment of the present invention showing the relationship among the barrel housing, the barrel latch and the inner barrel.
Figure 26:
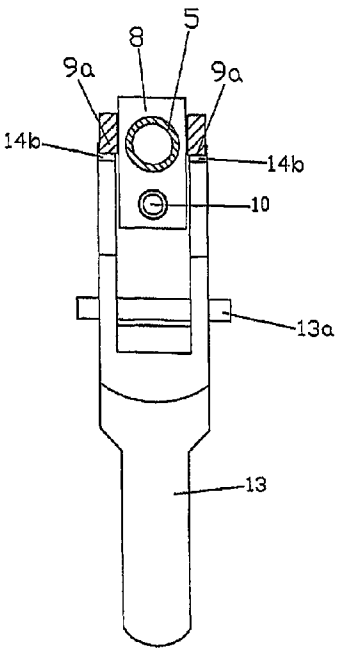
FIG. 26 is an enlarged side cross-sectional drawing of the essential parts according to an embodiment of the present invention showing the relationship among the barrel housing, the barrel latch and the inner barrel.

An air gun with a blowback mechanism according to an embodiment of the present invention will now be explained referring to FIGS. 1 to 9 that are front section explanatory drawings showing one cycle of actions until shooting of a bullet from an air gun, FIGS. 10 to 18 that are enlarged front cutaway sections of essential parts, FIGS. 19 to 23 that are the discharge valve used in the air gun of the present invention, and FIG. 24 to 26 that show the relationships among the inner barrel, the barrel housing and the barrel latch.

Figure 1:
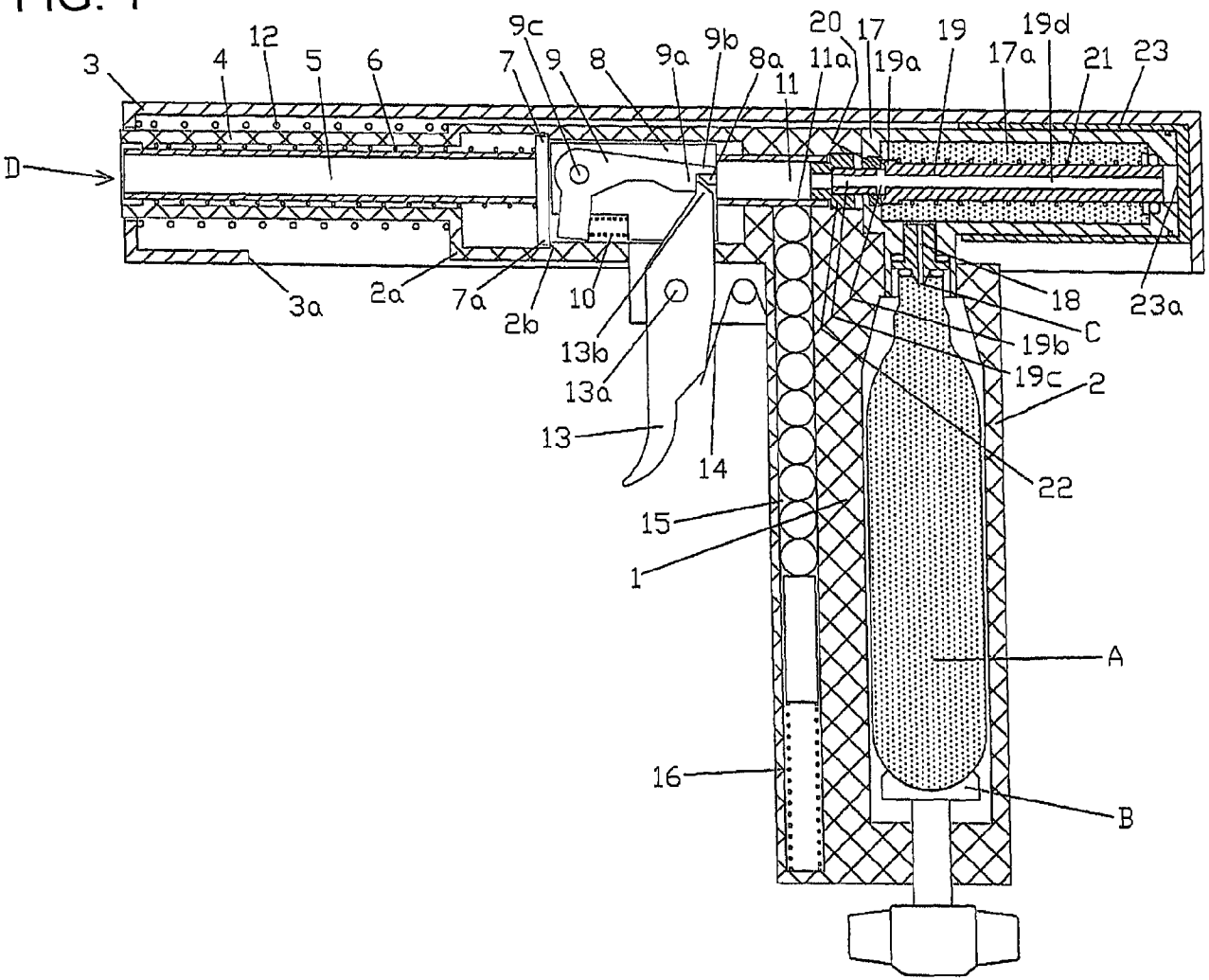
FIG. 1 is a front cutaway section of the overall structure of an air gun with a blowback mechanism according to an embodiment of the present invention having a magazine containing bullets and a cylinder containing compressed gas inserted into the air gun.

FIG. 1 is a front cutaway section showing the overall structure of an air gun with a blowback mechanism according to an embodiment of the present invention, with a magazine containing bullets and a cylinder containing compressed gas inserted into the air gun.

Figure 10:
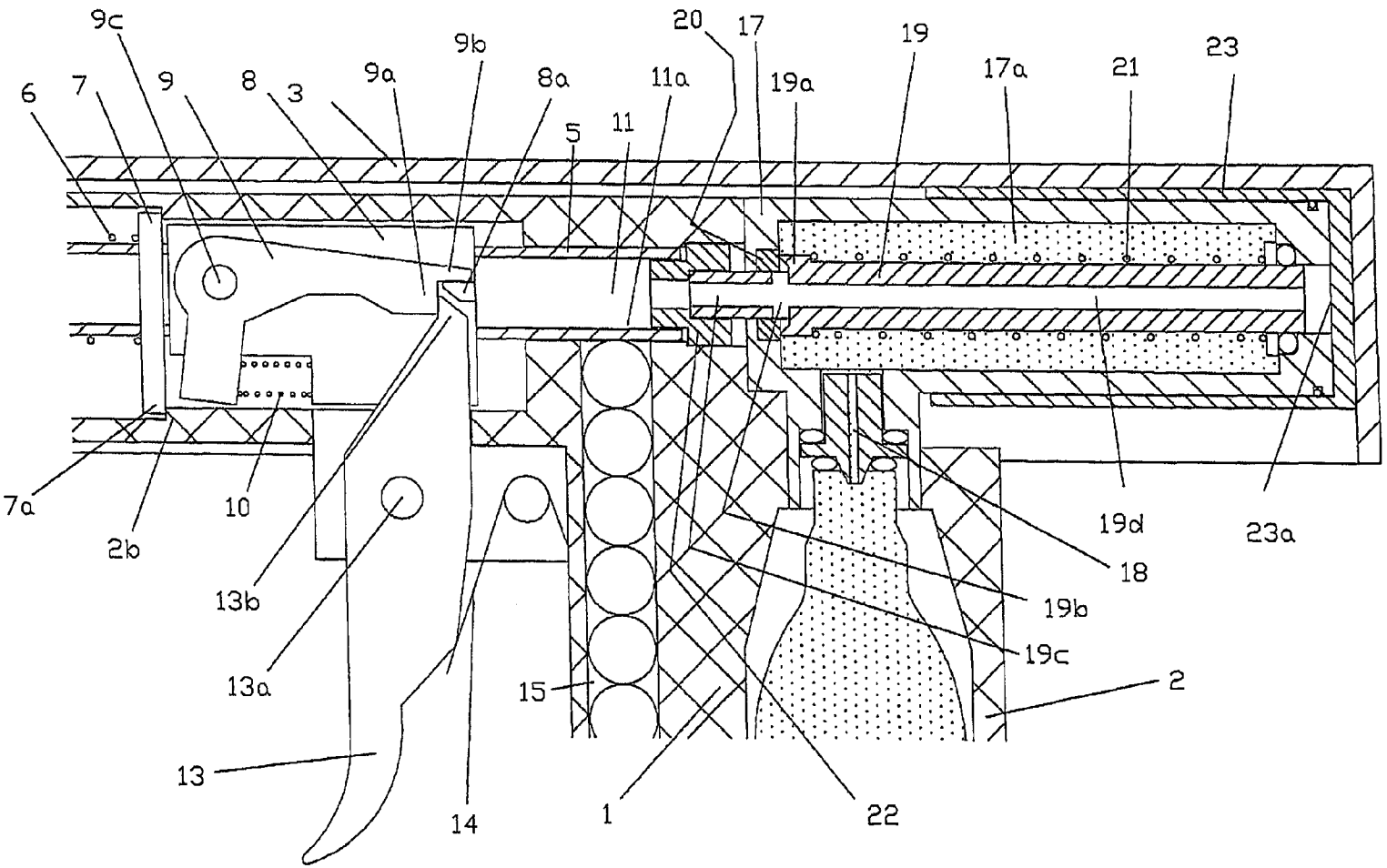
FIG. 10 is an enlarged front cutaway section of essential parts showing an initial state of a valve body air chamber, a discharge valve, a hit pin, barrel latch, etc shown in FIG. 1.

A structure of an air gun with a blowback mechanism according to an embodiment of the present invention will now be explained referring to FIG. 1 and FIG. 10 that is a partially enlarged drawing of FIG. 1. An air gun according to an embodiment of the present invention is an automatic air gun that shoots a bullet W using gas pressure of compressed carbon dioxide gas while performing blowback and loading of the next bullet. In this embodiment, compressed dioxide gas is used. However, the gun may be operated by other compressed gases such as compressed nitrogen gas and compressed air. Hereinafter, compressed dioxide gas is called compressed gas in this embodiment.

A frame (grip) 2 is provided at the bottom of the gun rear end side of the air gun main body 1. The frame 2 contains a replacable gas cylinder A that is a compressed gas source supplying compressed gas. An accumulator may be provided in the frame 2 as a compressed gas source other than an accumulator cylinder A. The gas cylinder A is inserted from the side of the frame 2 and pressed upward by a cap screw so that a gas supplying port C at the upper end is opened and the compressed gas is supplied to a valve body air chamber 17*a* via a gas passage 18. In this embodiment, the gas cylinder A of compressed gas is contained in the frame 2. However, the gas cylinder A may be attached to the outside of the frame 2 or gas may be supplied from a gas cylinder worn by a user to the air gun main body 1 via hose, etc.

The major parts of the air gun of the present invention include an air gun main body with a frame 2 (grip) at the back side, a magazine 15 detachable to and from the frame 2, an inner barrel 5 that is a bullet path, an outer barrel 4 provided outside the inner barrel, a slide 3 slidably provided parallel to the outer barrel 4, a cylinder 23 fixed to the inside of the gun rear end side of the slide 3, a chamber 11 provided at the gun rear side of the barrel 5, a valve body 17 with a hollow valve body air chamber 17*a* provided between a chamber 11 and cylinder 23, a discharge valve 19 provided in the valve body air chamber 17*a*, a hit pin 22 provided between the inner barrel 5 and the discharge valve 19, and barrel latch 9 operated by a trigger 13.

The slide 3 can be slid along the outer barrel 4 and is biased on the muzzle side by the tensile force of a recoil spring 12. The inner barrel 5 is provided inside the outer barrel 4, both of which are cylindrical.

A barrel housing 8 is fixed in an integrated manner close to the center of the longitudinal direction of the inner barrel 5, can be freely slid along the outer barrel 4, and is biased towards the gun rear end side by the barrel spring 6. A barrel latch 9 is rotatably provided on the barrel housing 8 centering on the barrel latch rotational axis 9*c*. The uniform barrel latches 9 are attached to the two sides of the barrel housing 8 and the inner barrel 5 (Refer to FIGS. 24 to 26).

A barrel spring washer 7 is provided at the muzzle side of the barrel housing 8 and abuts on the gun rear end side of the barrel spring 6. The barrel spring 6 and barrel spring washer 7 are slidably provided between the tip of the muzzle side of the inner barrel 5 and the side of the muzzle of the barrel housing 8. The barrel spring washer 7 forms the lower part as a frame locking part 7*a*. The frame locking part 7*a* abuts on a barrel spring washer retreat stop part 2*b* to stop retreat of the barrel.

The lower part of the barrel latch 9 is biased to the muzzle side in the barrel housing 8 by the barrel latch spring 10. The gun rear end side is downwardly biased centering on the barrel latch rotational axis 9*c*. The barrel latch 9 is locked when the barrel housing locking part 9*b* formed at the gun rear end side of the barrel latch 9 abuts against the barrel latch locking part 8*a* of the barrel housing 8. The barrel latch 9 and the trigger abutment 9*a* formed on the gun rear end side lock and release the lock of the trigger upper top 13*b* and trigger 13.

The chamber 11 is a cylindrical space positioned between the rear end of the inner barrel 5 and the front end of the valve body 17. The lower surface opening 11*a* is provided on the lower surface of the chamber. The bullet W supplied from the magazine 15 is supplied into the chamber 11 via the lower surface opening 11*a*.

The trigger 13 is rotatably centered on the trigger axis provided on the air gun main body 1. The upper end of the trigger 13 is biased against the gun rear end side by the trigger spring 14.

The magazine 15 is detachably provided in the frame 2. Multiple bullets W are loaded in the magazine 15. A magazine spring 16 is provided in the magazine 15. Bullets W are always biased upwards by the magazine spring 16. When the magazine 15 is inserted into the frame 2, a bullet W abuts against the lower part of the outer circumferential surface of the rear end of the inner barrel 5 and is locked. When the inner barrel 5 moves towards the muzzle, a bullet W moves upwards by the urging force of the magazine spring 16 and is placed in the chamber 11 (the bullet is loaded in the chamber).

The valve body 17 fixed to the frame 2 is provided between the chamber 11 on the muzzle side and the cylinder 23 on the gun rear side and incorporates a hollow valve body air chamber 17*a* inside. The valve body 17 can be sealed to contain the compressed gas. The discharge valve 19 is provided in the valve body air chamber 17*a* capable of moving away from the muzzle side to the gun rear end side.

As shown in FIG. 19 to 23, the discharge valve 19 has a valve through hole 190 passing from the muzzle side to the gun rear end side in the valve body air chamber 17*a*, is cylindrical, has the flange part 19*a* on the circumference, and has a valve spring 21 that biases the discharge valve 19 towards the muzzle on the circumferential surface. The diameter of the flange part 19*a* is larger than the other outer diameters of the discharge valve 19. If the discharge valve 19 is biased towards the muzzle side by the valve spring 21, the flange part 19*a* abuts against the valve packing 20 provided in front of the valve body air chamber 17*a* to close the gas inlet port 19*b* and the inside of the valve body air chamber 17*a*.

The discharge valve 19 has the gas inlet port 19*b* that can open or close the valve body air chamber 17*a* and valve through hole 190 depending on the movement from the muzzle to the gun rear end side on the muzzle side of the flange part 19*a* and further has a discharge valve front part 19*c* with a front through hole 190*b* on the muzzle side of the gas supply port 19*b*. The cylindrical diameter of the discharge valve front part 19*c* is smaller than the cylindrical diameter of the rear of the flange part 19*a*. The cylindrical diameter of the discharge valve front part 19*c* can fit the internal cylindrical diameter of the hit pin 22 described below.

The valve through hole 190 passes completely from the muzzle to the gun rear end side. A rear through hole 190*a* is formed at the gun rear end side of the gas supply port 19*b* and a front through hole 190*b* is formed at the muzzle side.

The hit pin 22 is positioned at the muzzle side of the discharge valve 19, has a pin through hole 22*a* that completely pass from the muzzle to the gun rear end side, and can move in the longitudinal direction. In this embodiment, the hit pin 22 fits the discharge valve front part 19*c* of the discharge valve 19. The hit pin 22 can move the discharge valve 19 in the longitudinal direction by the retreat of the inner barrel 5.

The cylinder 23 is slidably provided on the slide 3 in an integrated manner. The cylinder 23 is cylindrical and provided with the rear wall surface on the gun rear end side. The inner surface of the wall is constituted as the cylinder pressure receiving surface 23*a*. The rear part of the valve body 17 is inserted into the cylinder 23.

In this embodiment, the gas cylinder A is provided in the frame 2 of the air gun main body. The gas cylinder is inserted into the frame 2. When the gas supply port C is opened by the pin in the frame, the compressed gas in the gas cylinder A passes through the gas supply port C and gas passage to impregnate the valve body air chamber 17*a* so that the initial state is obtained.

One cycle of shooting a bullet from an air gun with a blowback mechanism according to an embodiment of the present invention will now be explained referring to FIGS. 2 to 9 and FIGS. 11 to 18 that are enlarged front cutaway sections of essential parts corresponding to FIGS. 2 to 9.

Figure 2:
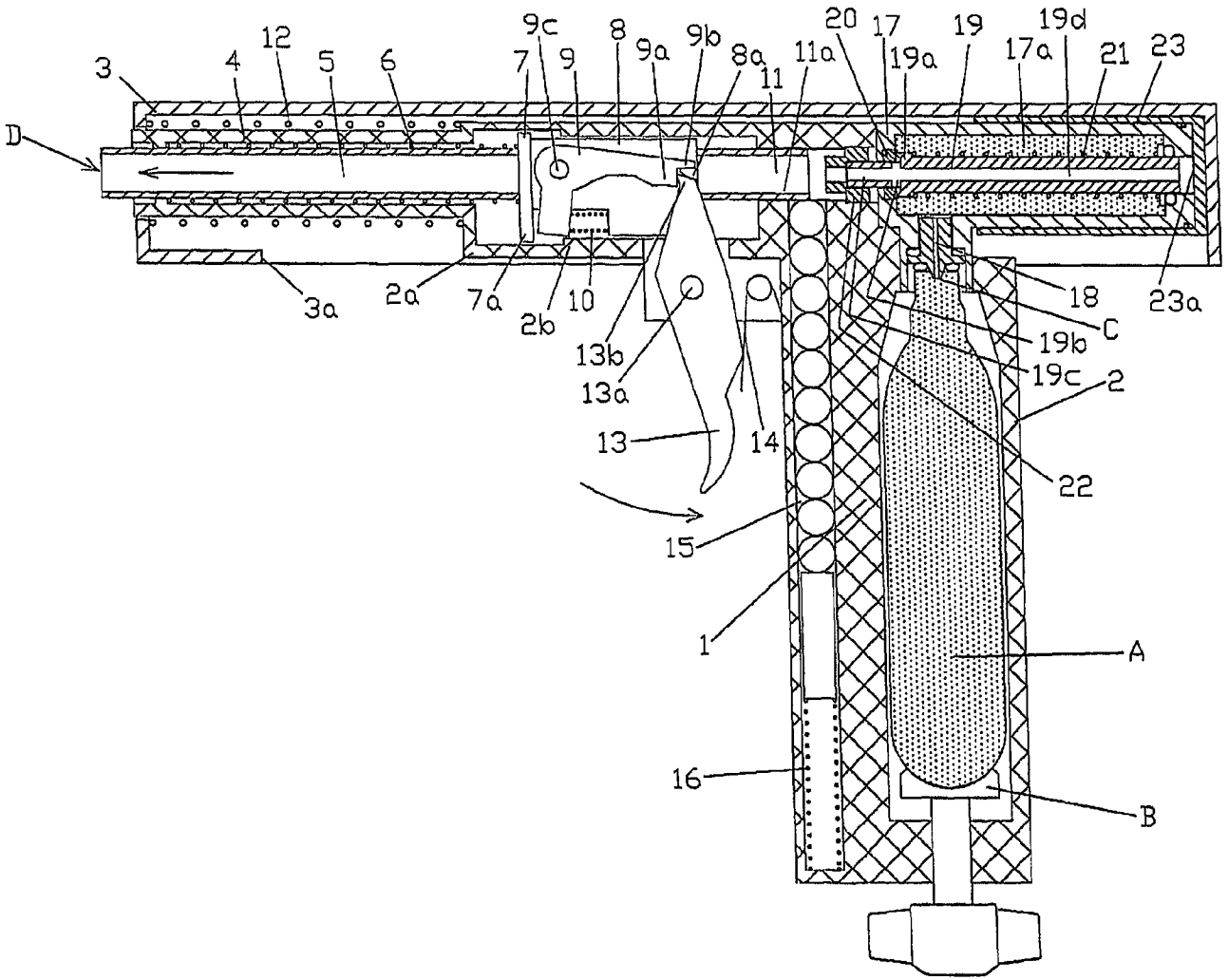
FIG. 2 is a front cutaway section of an action of the air gun with a blowback mechanism according to an embodiment of the present invention, and showing a state immediately after a shooter has started manually sliding a slide towards the gun rear end side.
Figure 11:
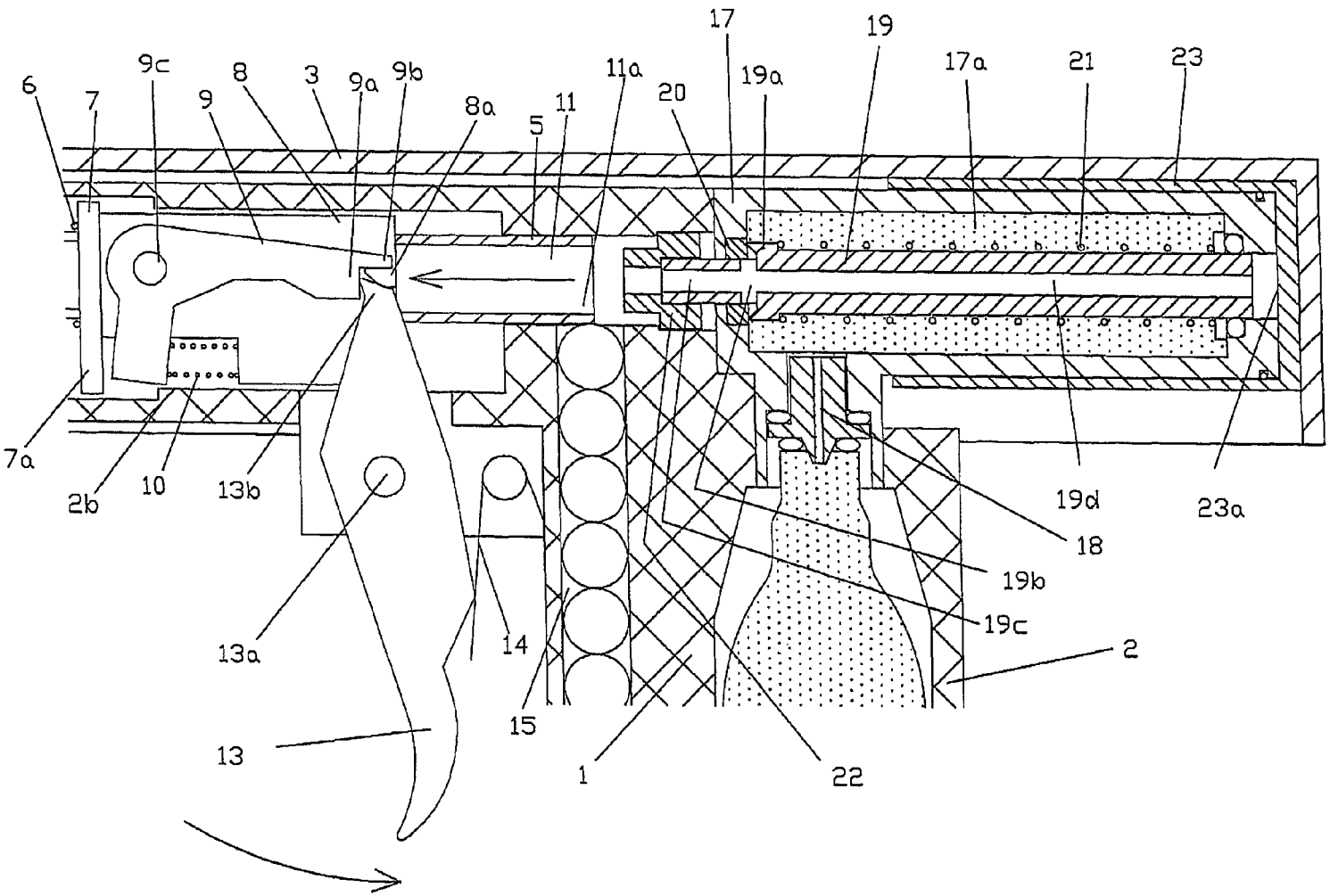
FIG. 11 is an enlarged front cutaway section of essential parts showing operations of a valve body air chamber, a discharge valve, a hit pin, barrel latch, etc. shown in FIG. 2.

FIGS. 2 and 11 show a state in which a user manually pulls the trigger 13 towards the gun rear end side starting from the state shown in FIG. 1. The trigger 13 rotates centering on the trigger axis 13*a* and the upper tip part 13*b* of the trigger abuts against and presses the trigger abutting part 9*a* of the barrel latch 9. At the same time, the barrel housing 8 presses the barrel spring washer 7 towards the muzzle side. The barrel spring washer 7 moves to the muzzle side while pressing the barrel spring 6. At the same time, the inner barrel 5 and the barrel housing 8 move towards the muzzle.

Figure 3:
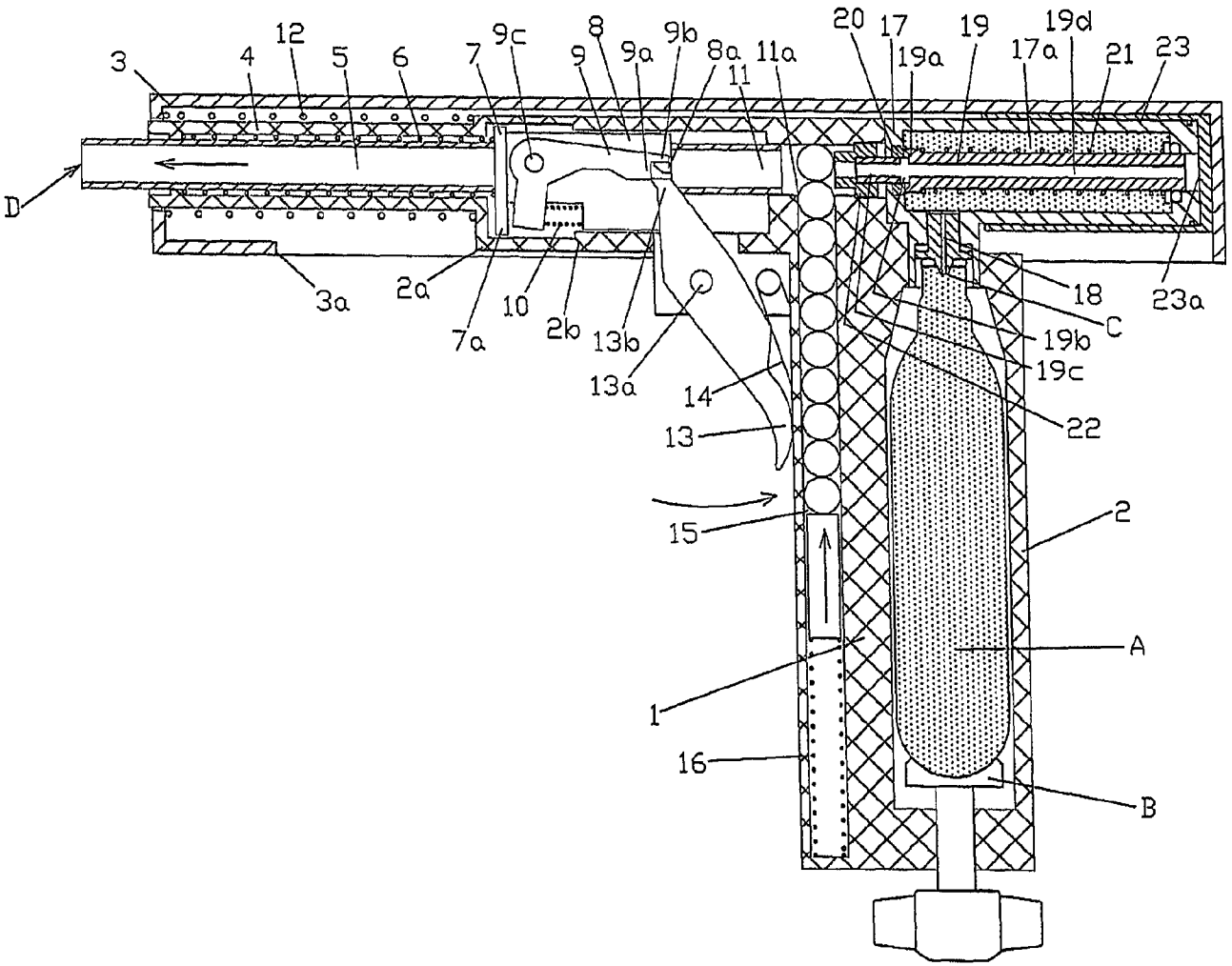
FIG. 3 is a front cutaway section of the state after the state shown in FIG. 2.
Figure 12:
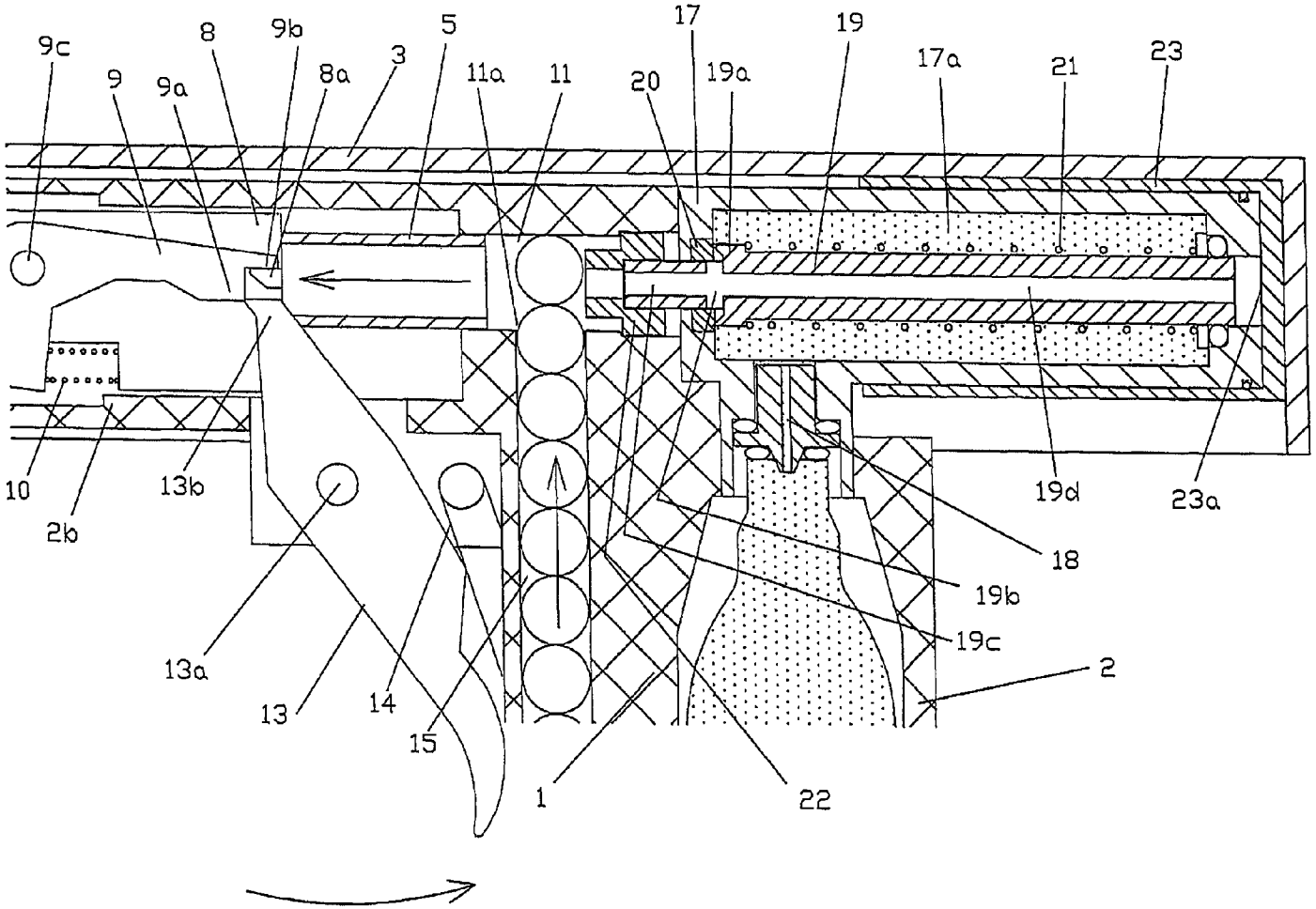
FIG. 12 is an enlarged front cutaway section of essential parts showing operations of a valve body air chamber, a discharge valve, a hit pin, barrel latch, etc. shown in FIG. 3.

Now, FIGS. 3 and 12 will be explained. If the trigger 13 is pulled further towards the gun rear end side, the upper tip part 13*b* of the trigger is tripped from the trigger abutting part 9*a* of the barrel latch 9 and the abutment between the trigger 13 and the barrel latch 9 is released.

In FIGS. 2 and 11, a bullet W is biased above the magazine spring 16 in the magazine 15 and the bullet cannot move into the chamber 11 because it abuts on the lower part of the circumference of the rear end of the inner barrel 5. In the state shown in FIGS. 3 and 12, the inner barrel 5 moves towards the muzzle side and the lower surface opening 11*a* of the chamber 11 opens and a bullet W is inserted into the chamber 11 from the lower surface opening 11*a* to be loaded.

Figure 4:
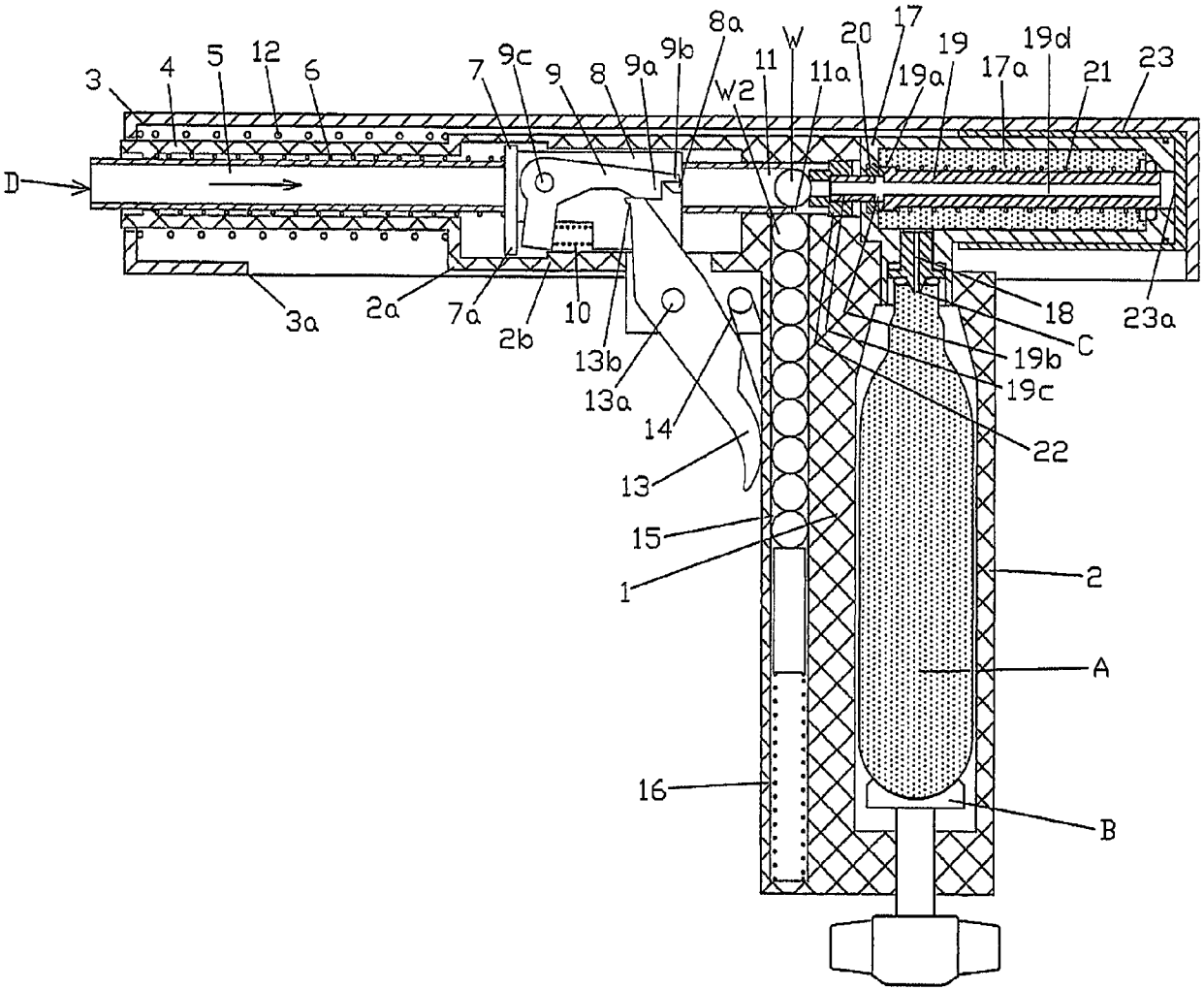
FIG. 4 is a front cutaway section of the state after the state shown in FIG. 3.
Figure 13:
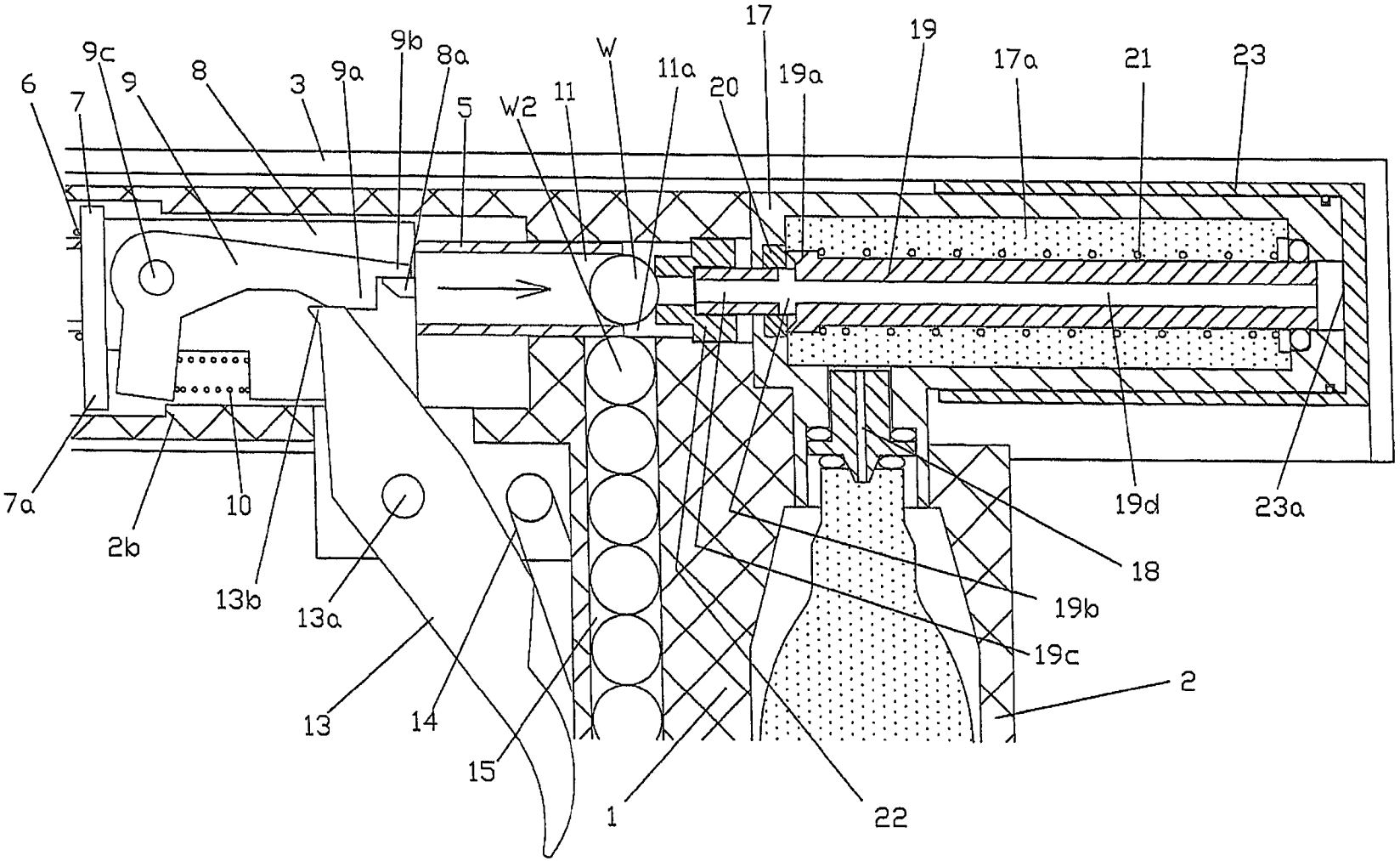
FIG. 13 is an enlarged front cutaway section of essential parts showing operations of a valve body air chamber, a discharge valve, a hit pin, barrel latch, etc. shown in FIG. 4.

FIGS. 4 and 13 will now be explained. When the abutment between the trigger 13 and the barrel latch 9 is released, the barrel spring 6 presses and moves the barrel spring washer 7 towards the gun rear end side by its urging force. The urging force of the barrel spring 6 moves the inner barrel 5 and barrel housing 8 towards the gun rear end side in an integrated manner via the barrel spring washer 7. When the inner barrel 5 moves further towards the gun rear end side, the bullet W loaded in the chamber 11 is inserted into the inner diameter of the inner barrel 5 from the gun rear end of the inner barrel. At the same time, the next bullet W2 in the magazine 15 abuts on the rear end circumferential surface of the inner barrel 5 and stops.

Figure 5:
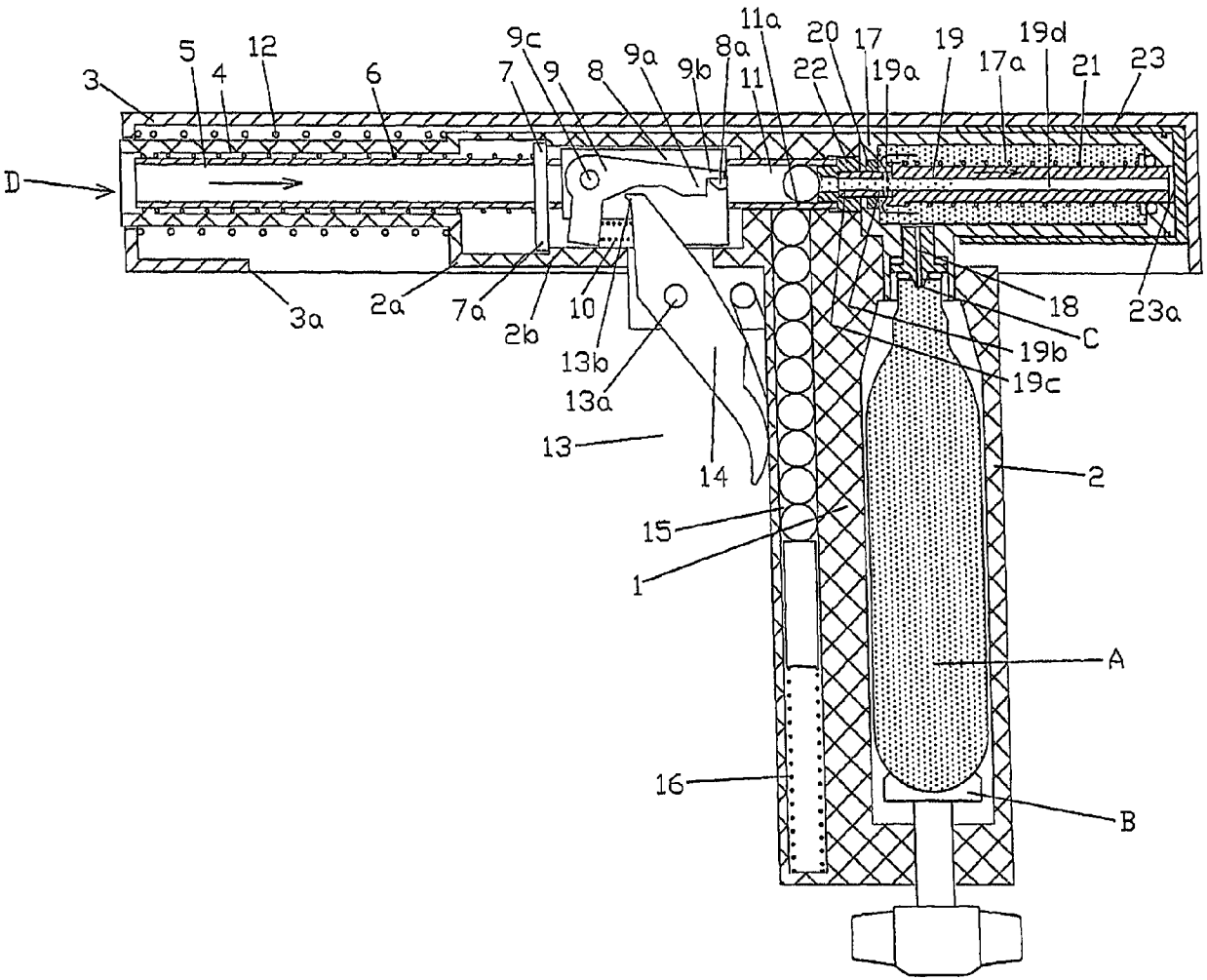
FIG. 5 is a front cutaway section of the state after the state shown in FIG. 4.
Figure 14:
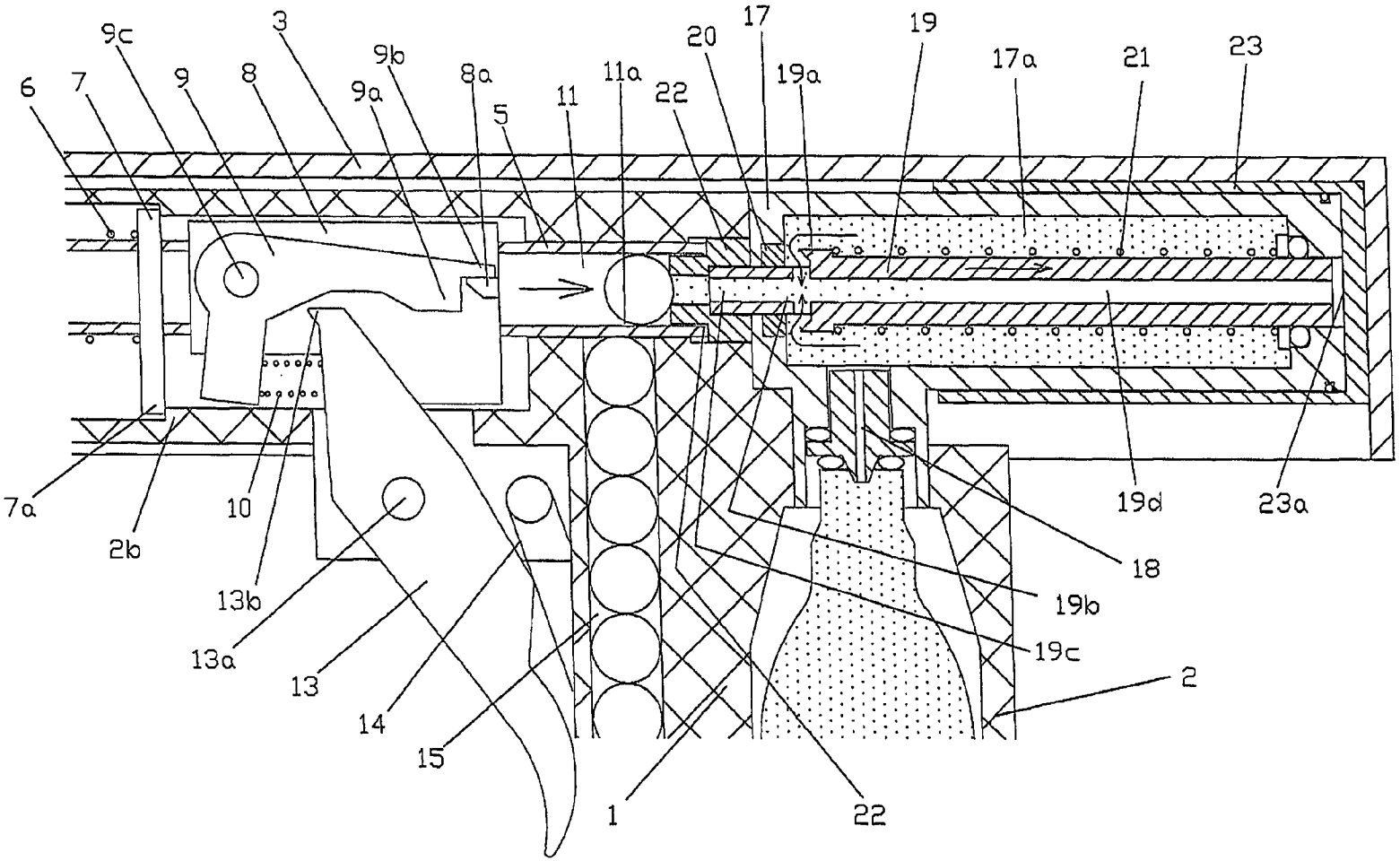
FIG. 14 is an enlarged front cutaway section of essential parts showing operations of a valve body air chamber, a discharge valve, a hit pin, barrel latch, etc. shown in FIG. 5.

FIGS. 5 and 14 will now be explained. The inner barrel 5 moves further towards the gun rear end side from the state shown in FIGS. 4 and 13. Then, the barrel spring washer 7 stops retreating towards the gun rear end side because the frame locking part 7*a* formed below the barrel spring washer 7 abuts on the barrel spring washer retreat stop part 2*b* formed in the frame 2. The inner barrel 5 and the barrel housing 8 keep on moving towards the gun rear end side by the movement inertial force due to their own weight, even though the barrel spring washer 7 has stopped retreating. Thus, the barrel spring washer 7 is removed from the barrel housing 8.

The gun rear end side of the inner barrel 5 keeps on moving backward due to its inertial force, enters the inner circumference of the chamber 11, hits the hit pin 22 and presses and moves the hit pin 22 towards the gun rear end side.

Figure 6:
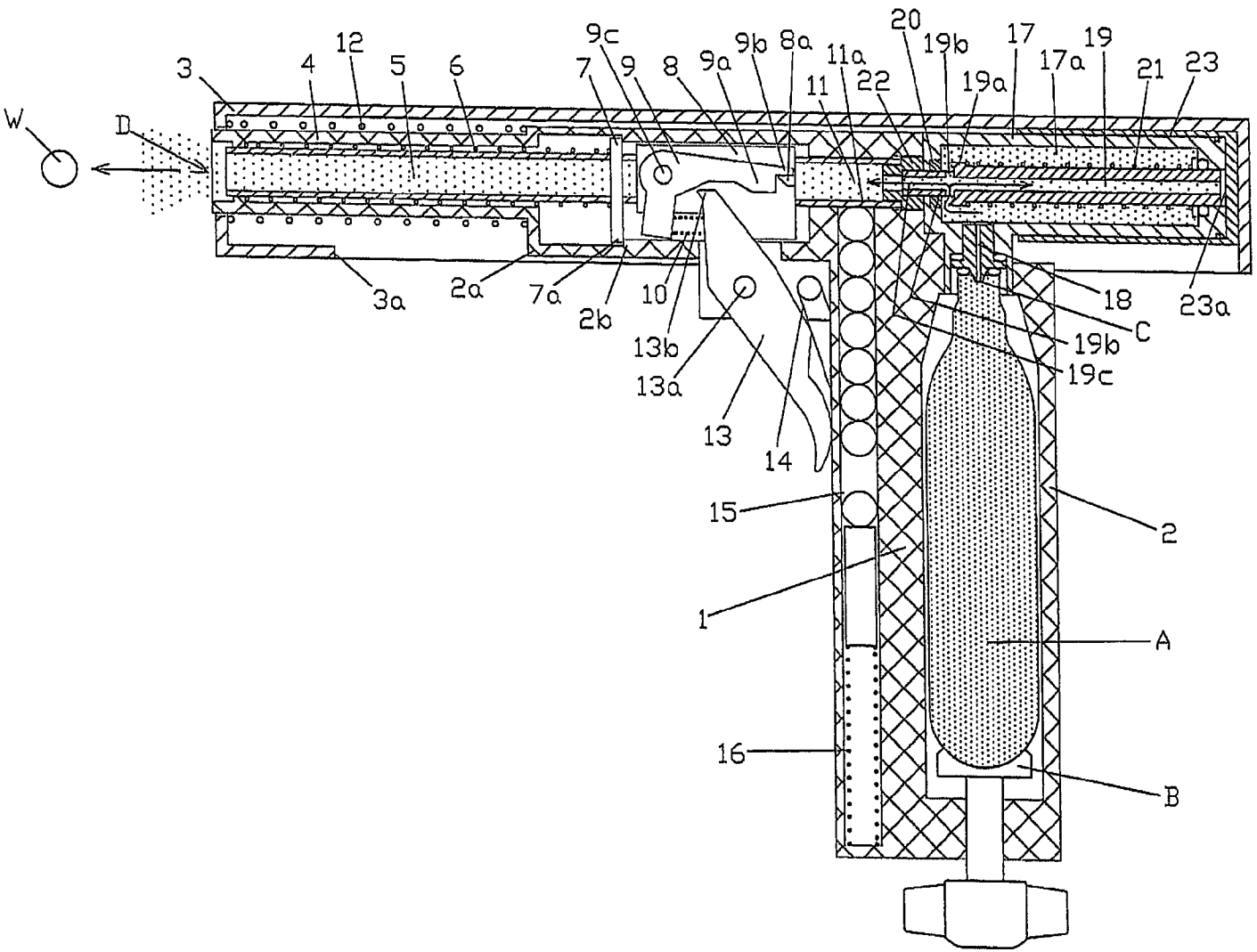
FIG. 6 is a front cutaway section of the state in which a bullet is shot after the state shown in FIG. 4.
Figure 15:
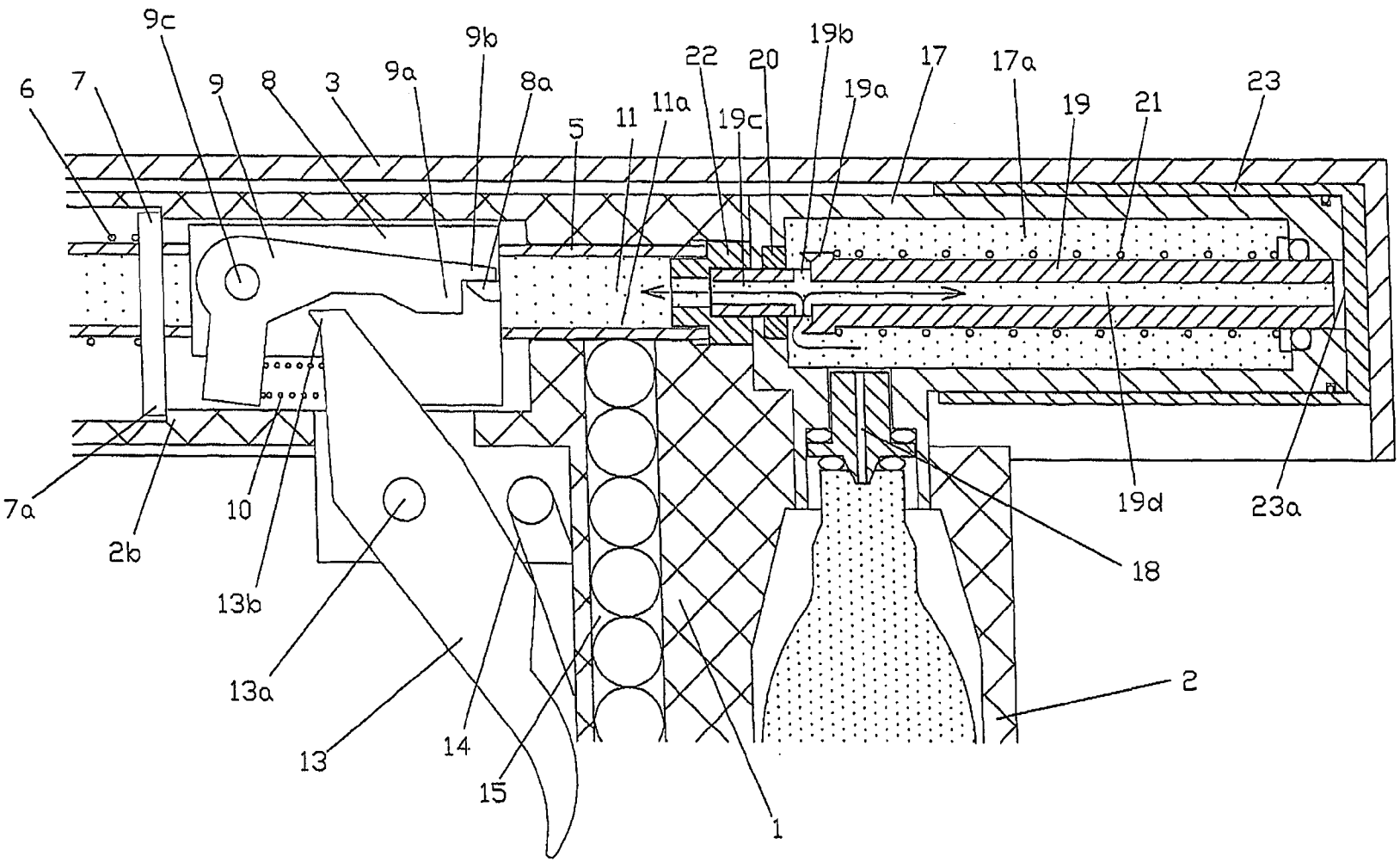
FIG. 15 is an enlarged front cutaway section of essential parts showing operations of a valve body air chamber, a discharge valve, a hit pin, barrel latch, etc. shown in FIG. 6.

FIGS. 6 and 15 will now be explained. When the inner barrel 5 retreats to make the hit pin 22 move towards the gun rear end, the discharge valve 19 which fits the hit pin 22 also retreats towards the gun rear end side. The flange part 19*a* moves away from valve gasket 20 due to the retreat of the discharge valve 19, and the gas supply port 19*b* communicates with the valve body air chamber 17*a*. Therefore, the gas filled in the valve body air chamber 17*a* enters the valve through hole 190 via the gas supply port 19*b*. Some of the gas enters the inner barrel 5 from the front through hole 190*b* via pin through path 22*a*. The gas pressure shoots the bullet W in the inner barrel 5 from the muzzle.

Figure 7:
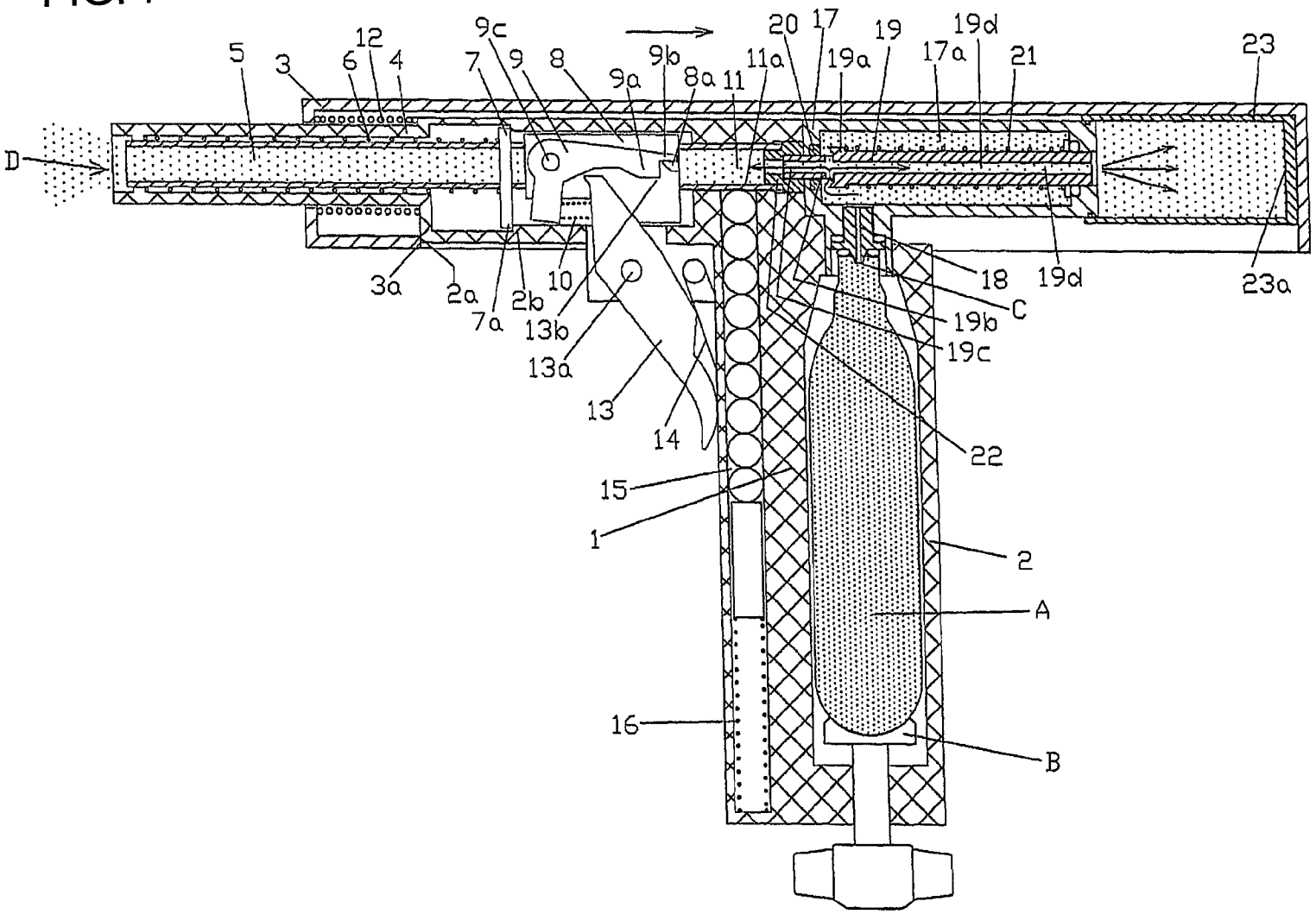
FIG. 7 is a front cutaway section of the state in which a slide moves towards a gun rear end side by gas pressure from a valve body air chamber after the state shown in FIG. 6.
Figure 16:
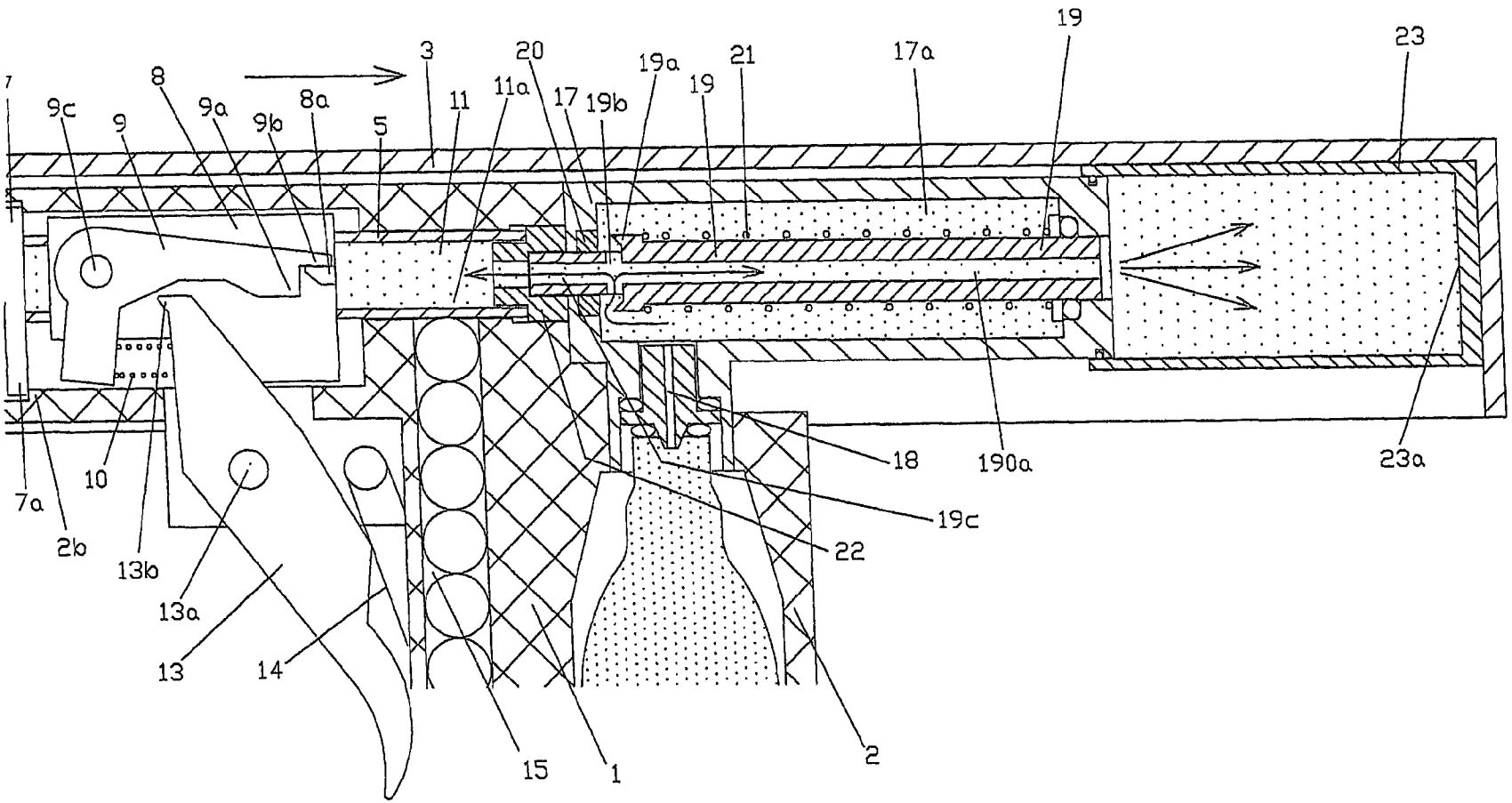
FIG. 16 is an enlarged front cutaway section of essential parts showing operations of a valve body air chamber, a discharge valve, a hit pin, barrel latch, etc. shown in FIG. 7.

FIGS. 7 and 16 will now be explained. The remaining gas enters the valve through hole 190 from the valve body air chamber 17*a* via the gas supply port 19*b*, and discharged from the opening at the rear end of the discharge valve 19 to press the cylinder pressure receiving surface 23*a*. This pressure thrusts back the cylinder 23 and the slide 3 consolidated with the cylinder 23. The slide 3 and the cylinder 23 further keep on retreating while resisting the urging force of the recoil spring 12 because the gas in the valve body air chamber 17*a* keep on blowing out. The slide 3 stops retreating when the slide locking part 3*b* provided on the lower part of the muzzle side of the slide 3 abuts on the slide retreat stopping part 2*a* provided on the frame 2. The gas remaining in the cylinder 23 is discharged into the atmosphere from the muzzle side opening of the cylinder 23.

Figure 8:
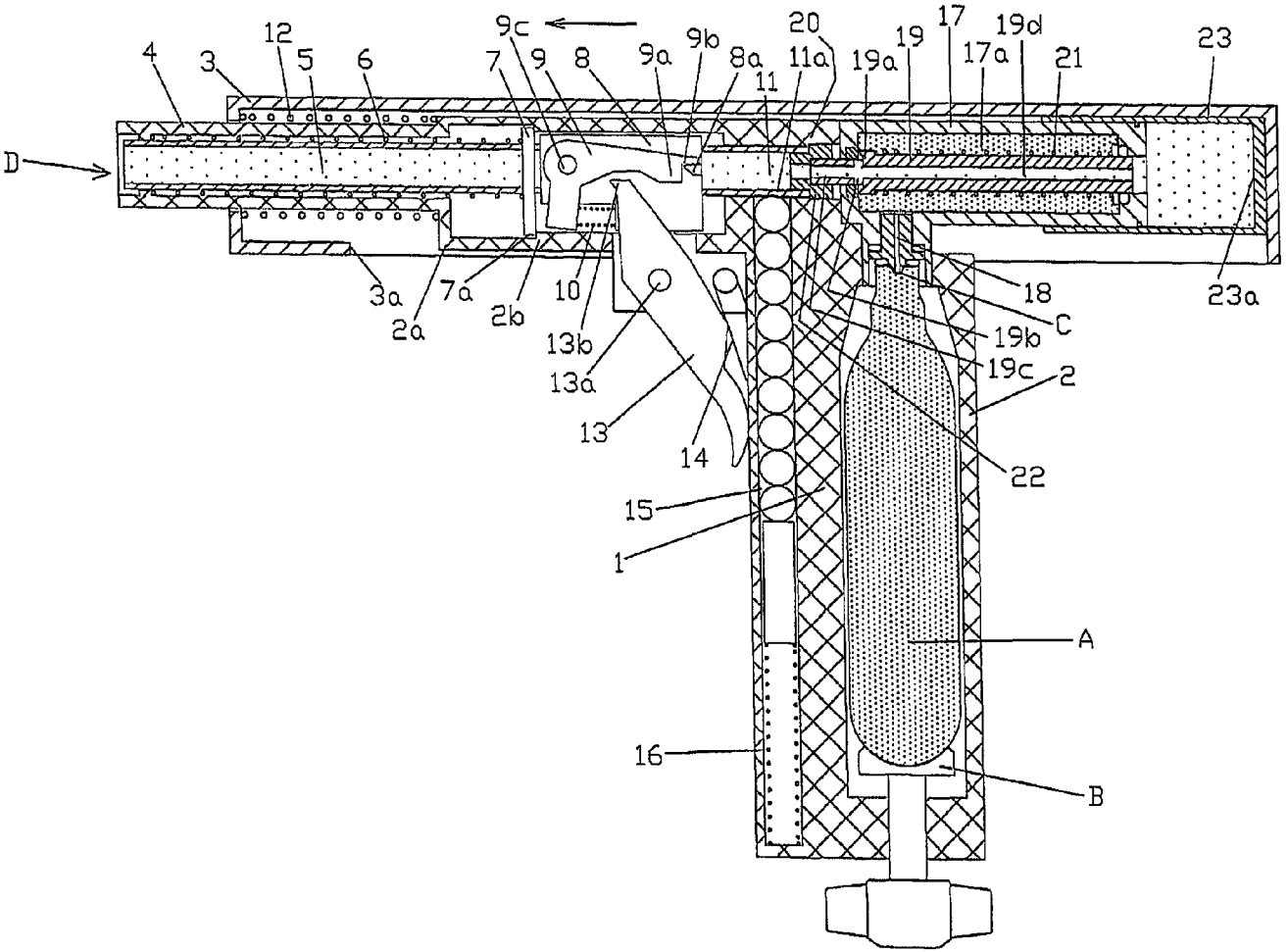
FIG. 8 is a front cutaway section of the state in which a slide has reached a gun rear end and is moving towards the muzzle side of the air gun by the force urged by a barrel spring after the state shown in FIG. 7.
Figure 17:
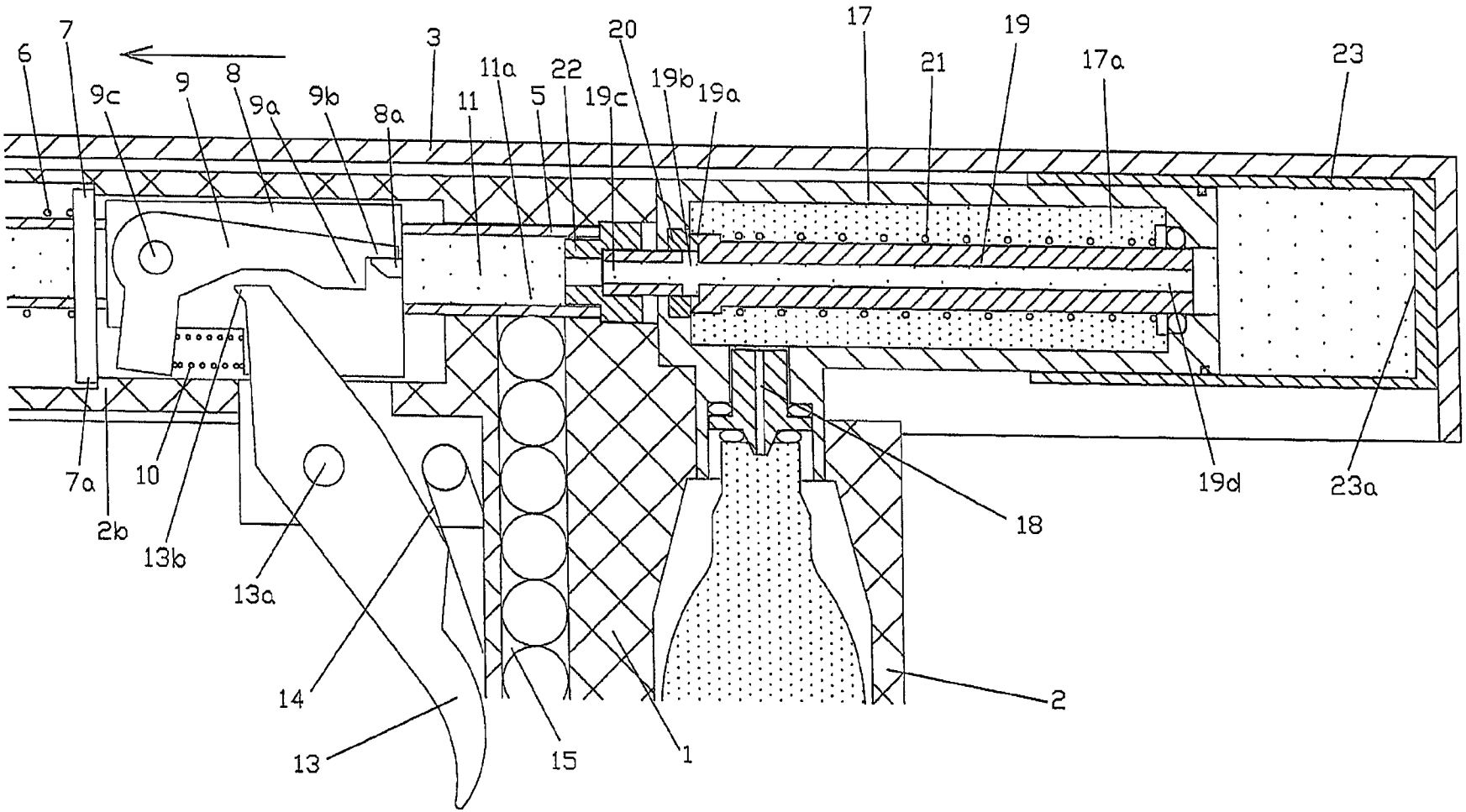
FIG. 17 is an enlarged front cutaway section of essential parts showing operations of a valve body air chamber, a discharge valve, a hit pin, barrel latch, etc. shown in FIG. 8.
Figure 18:
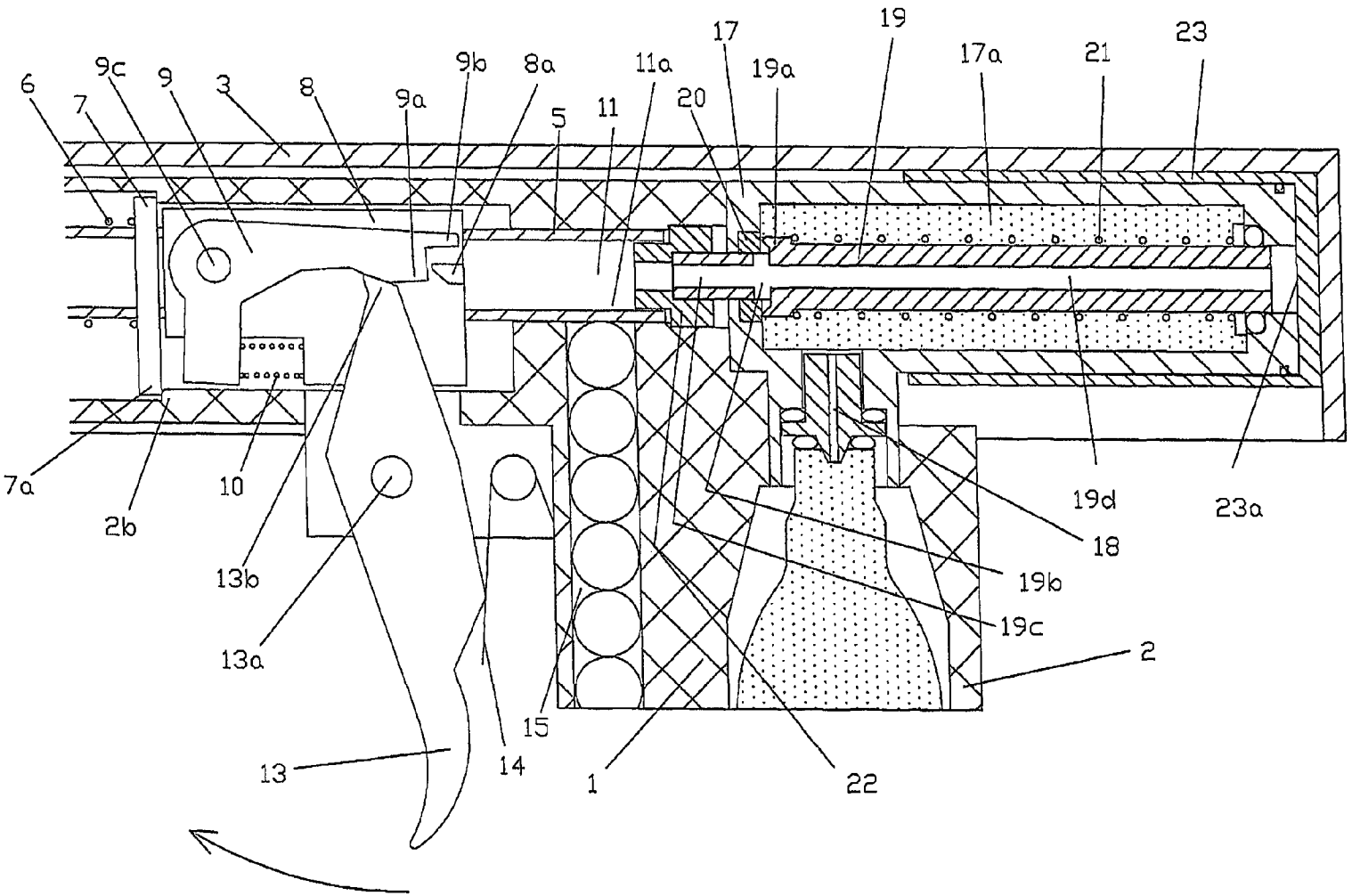
FIG. 18 is an enlarged front cutaway section of essential parts showing operations of a valve body air chamber, a discharge valve, a hit pin, barrel latch, etc. shown in FIG. 9.

FIGS. 8 and 17 will now be explained. The slide 3 starts advancing towards the muzzle by the urging force of the recoil spring 12. This advancing movement stops when the rear part of the valve body 17 is inserted into the cylinder 23 and the cylinder pressure receiving surface in the cylinder 23 abut on the gun rear side end surface of the valve body 17.

Figure 9:
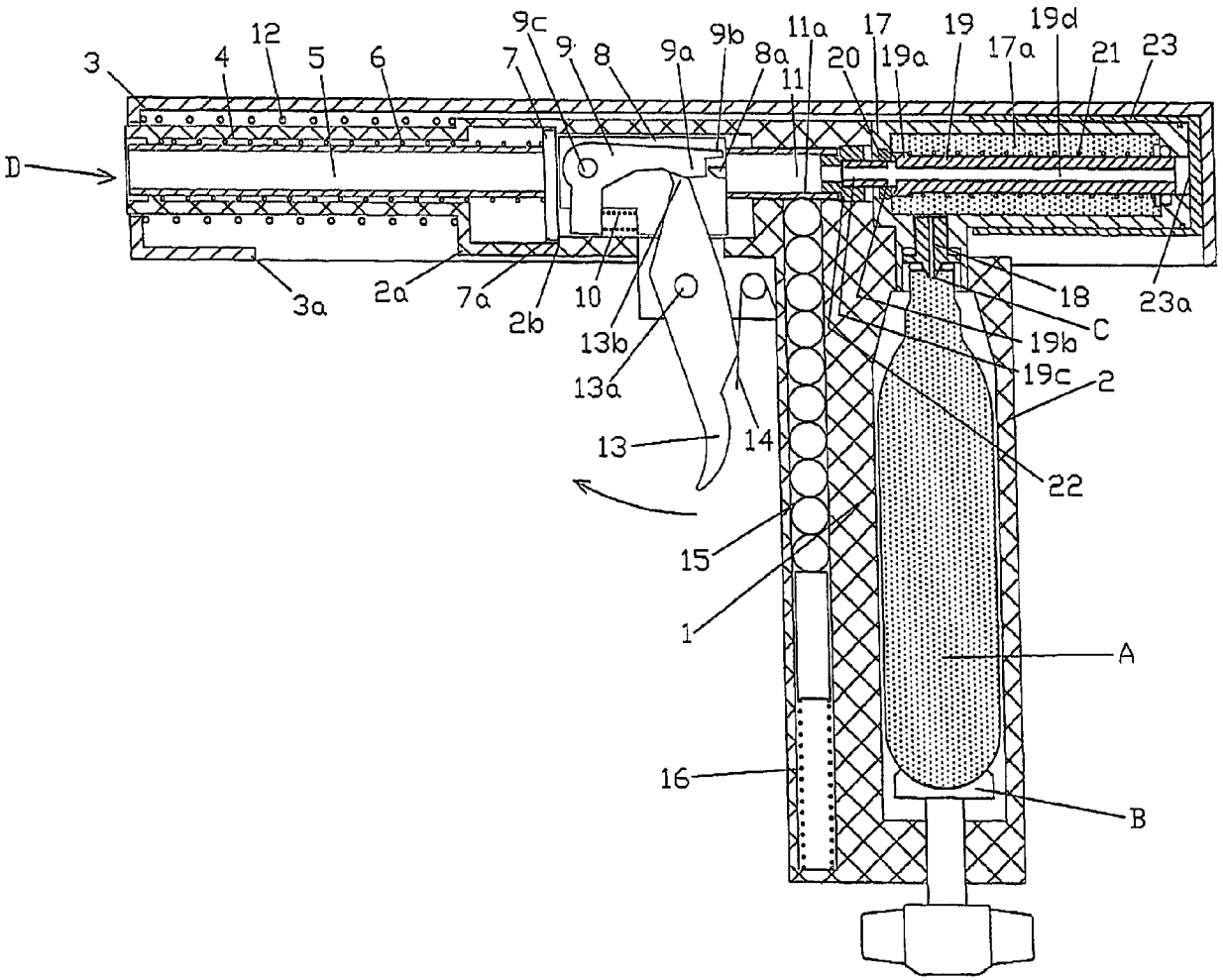
FIG. 9 is a front cutaway section of the state in which a trigger is returning to the original position after a series of bullet shooting and blowback actions have completed after the state shown in FIG. 8.
Figure 19:
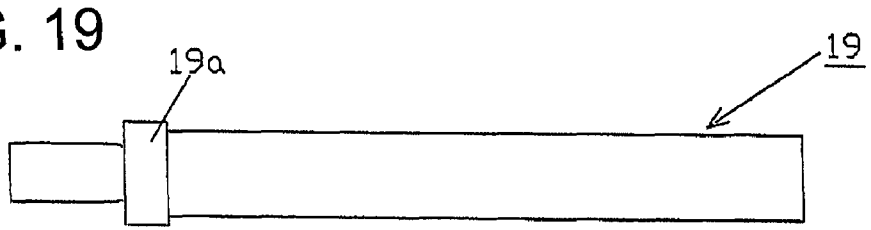
FIG. 19 is a front drawing of an embodiment of the discharge valve used in the present invention.
Figure 20:
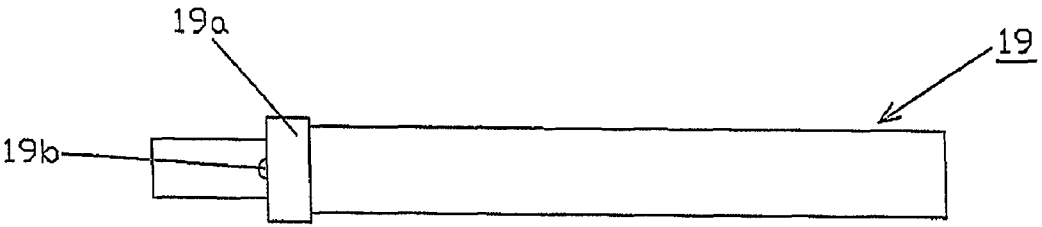
FIG. 20 is a plane drawing of the discharge valve.
Figure 23:
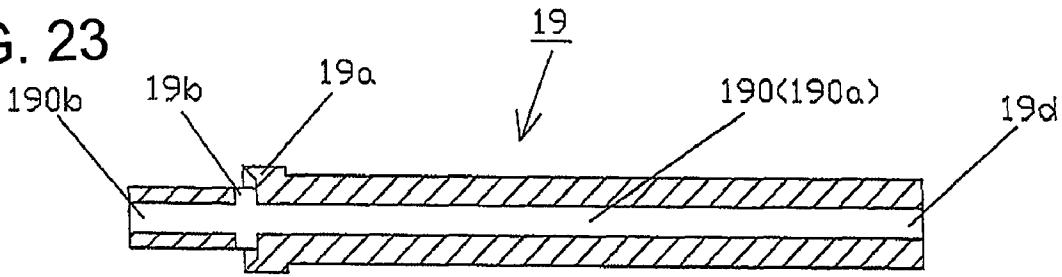
FIG. 23 is a front cross-sectional drawing of the discharge valve.
Figure 21:
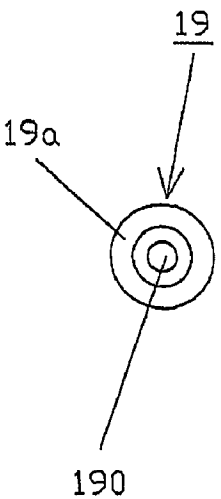
FIG. 21 is a left side drawing of the discharge valve seen from the muzzle side.
Figure 22:
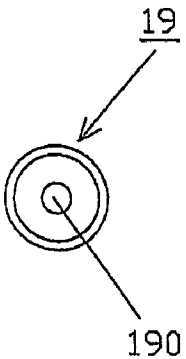
FIG. 22 is a right side drawing of the discharge valve seen from the gun rear end side.

FIGS. 9 and 19 will now be explained. When a user releases the finger from the trigger 13 from the state of FIG. 17, the trigger 13 rotates in a clockwise direction centering on the trigger axis 13*a* by the urging force of the trigger spring 14 to return to the original position (the state shown in FIG. 1).

The barrel latch 9 is raised by the upper tip part 14*b* of the trigger 13 due to the movement of the trigger 13 to return to the original position. After that, the barrel latch 9 is locked when the barrel housing locking part 9*b* of the barrel latch 9 abuts on the barrel latch locking part 8*a* of the barrel housing 8.

It is also possible, returning to the initial state shown in FIG. 1 from the state shown in FIG. 9, and following the operations from FIGS. 2 to 9, to repeat a series of shooting operations.

What is claimed is:

1. An air gun adapted for use with a compressed gas source providing a compressed gas, the air gun comprising:

an air gun main body including an inner barrel, a valve body, and a blowback mechanism operative to shoot a bullet and to perform blowback using the compressed gas, wherein the valve body is provided with a valve body air chamber that can be sealed to contain the compressed gas supplied from the compressed gas source, and a discharge valve that can move in a longitudinal direction to and between a muzzle end side and a gun rear end side in the valve body air chamber, the discharge valve has a valve through hole extending therethrough from the muzzle end side to the gun rear end side, and a gas inlet port that can open and close the valve body air chamber and the valve through hole by the movement of the discharge valve in the longitudinal direction from the muzzle end side to the gun rear end side, and the blowback mechanism moves the discharge valve towards the gun rear end side by retreat of the inner barrel, opens the gas inlet port of the discharge valve and causes the compressed gas to blow into the valve through hole from the valve body air chamber to shoot the bullet and perform blowback.

2. An air gun adapted for use with a compressed gas source providing a compressed gas, the air gun comprising:

an air gun main body including an inner barrel, a valve body, a barrel latch, a trigger, a hit pin and a blowback mechanism operative to shoot a bullet and to perform blowback using the compressed gas, wherein the valve body is provided with a valve body air chamber that can be sealed to contain the compressed gas supplied from the compressed gas source, and a discharge valve that can move in a longitudinal direction to and between a muzzle end side and a gun rear end side in the valve body air chamber, the discharge valve is provided with a valve through hole completely passing therethrough from muzzle end side to the gun rear end side, and a gas inlet port that can open and close the valve body air chamber and the valve through hole by movement of the discharge valve in the longitudinal direction from the muzzle end side to the gun rear end side, the hit pin is positioned at the muzzle end side of the discharge valve, is provided with a pin through hole extending therethrough from the muzzle end side to the gun rear end side, is movable in the longitudinal direction and moves the discharge valve towards the gun rear end side by retreat of the inner barrel, and the blowback mechanism moves the inner barrel by operation of the barrel latch activated by action of the trigger, moves the hit pin towards the gun rear end side by retreat of the inner barrel, opens the gas inlet port of the discharge valve by moving the discharge valve towards the gun rear end side and causes the compressed gas to blow into the valve through hole from the valve body air chamber to shoot the bullet and perform blowback.

* * * * *